US012545463B2

(12) United States Patent
Otxoa-Aizpurua Calvo et al.

(10) Patent No.: US 12,545,463 B2
(45) Date of Patent: Feb. 10, 2026

(54) VERTICAL PACKAGING MACHINE AND ASSOCIATED CONTROL METHOD

(71) Applicant: Ulma Packaging, S.Coop., Oñati (ES)

(72) Inventors: Alberto Otxoa-Aizpurua Calvo, Oñati (ES); Maitane Ayala Martín, Oñati (ES); Eneko Izquierdo Ereño, Oñati (ES)

(73) Assignee: Ulma Packaging, S.Coop., Oñati (ES)

( * ) Notice: Subject to any disclaimer, the term of this patent is extended or adjusted under 35 U.S.C. 154(b) by 0 days.

(21) Appl. No.: 18/923,002

(22) Filed: Oct. 22, 2024

(65) Prior Publication Data

US 2025/0042592 A1 Feb. 6, 2025

Related U.S. Application Data

(63) Continuation of application No. PCT/ES2023/070265, filed on Apr. 26, 2023.

(30) Foreign Application Priority Data

May 2, 2022 (EP) ..... 22382420

(51) Int. Cl.
*B65B 9/20* (2012.01)
*B65B 41/12* (2006.01)
*B65B 57/04* (2006.01)

(52) U.S. Cl.
CPC ..... *B65B 57/04* (2013.01); *B65B 9/20* (2013.01); *B65B 41/12* (2013.01)

(58) Field of Classification Search
None
See application file for complete search history.

(56) References Cited

U.S. PATENT DOCUMENTS 3,680,446 A * 8/1972 James ..... B65B 9/20 226/22
5,537,798 A * 7/1996 Fukuda ..... B65B 59/003 53/201

(Continued)

FOREIGN PATENT DOCUMENTS

EP 0307125 A2 3/1989
EP 2497716 A 9/2012

(Continued)

OTHER PUBLICATIONS

International Search Report and the Written Opinion, PCT/ES2023/070265, Sep. 12, 2023, 11 pages.

(Continued)

*Primary Examiner* — Chinyere J Rushing-Tucker
(74) *Attorney, Agent, or Firm* — Edell, Shapiro & Finnan, LLC

(57) ABSTRACT

Packaging machine that includes a frame, a feed module configured to supply a film, a fold forming module configured to receive the film and for generating at least one longitudinal fold in said film, actuation means with a first actuator to cause the movement of the feed module with respect to the frame, and with a second actuator for moving the forming module with respect to the feed module. A control unit is configured to cause, while the film is being supplied, the first actuator to move at least the feed module with respect to the frame and the second actuator to move the forming module at least with respect to the feed module.

13 Claims, 4 Drawing Sheets

(56) References Cited

U.S. PATENT DOCUMENTS

| | | | | |
|---|---|---|---|---|
| 6,725,625 | B1 * | 4/2004 | Honma | B65B 51/306 53/64 |
| 2005/0241269 | A1 * | 11/2005 | Maria Van Rens | B29C 66/1122 53/551 |
| 2006/0144020 | A1 | 7/2006 | Kettner et al. | |
| 2018/0016047 | A1 * | 1/2018 | Miyamoto | B65B 51/26 |
| 2022/0081144 | A1 * | 3/2022 | Tong | B65H 26/02 |

FOREIGN PATENT DOCUMENTS

| | | | |
|---|---|---|---|
| JP | 2013103752 | A | 5/2013 |
| JP | 2019104158 | A | 6/2019 |
| WO | 2009139618 | A1 | 11/2009 |

OTHER PUBLICATIONS

EP Search Report, Application No. 22382420.2, Oct. 20, 2022, 9 pages.

* cited by examiner

VERTICAL PACKAGING MACHINE AND ASSOCIATED CONTROL METHOD

CROSS-REFERENCE TO RELATED APPLICATIONS

This application relates to and claims the benefit and priority to International Application No. PCT/ES2023/070265, filed Apr. 28, 2023, which relates to and claims the benefit and priority to European Application No. EP22382420.2, filed May 2, 2022, each of which is incorporated by reference herein in its entirety.

FIELD

The present invention relates to vertical packaging machines and to control methods suitable for vertical packaging machines.

BACKGROUND

A vertical packaging machine comprises a hollow forming tube with an inlet opening and an outlet opening downstream of the inlet opening. The forming tube is configured for receiving a continuous film and for imparting a tubular shape to said film. The machine comprises a longitudinal sealing tool for longitudinally sealing the longitudinal edges of said film with a tubular shape, with a film tube being generated.

The machine further comprises a transverse sealing and cutting tool downstream of the forming tube and of the longitudinal sealing tool, for cutting the film tube and sealing said film tube on both sides of the cut, generating a film tube closed at one end upstream of the cut, and a closed package downstream of the cut. In order to be packaged, a product is fed to the forming tube through the inlet opening of said forming tube and exits through the outlet opening of said forming tube, being deposited on the transverse sealing and cutting tool or on the closed end of the film tube as a last resort. The machine comprises a driving tool for causing the forward movement of the film tube, such that when the transverse sealing and cutting tool acts, part of the film tube comprising a product therein is located downstream of the forming tube and of the transverse sealing and cutting tool. Therefore, after the actuation of said transverse sealing and cutting tool, said product is packaged in a package that is physically separated from the film tube.

For the longitudinal sealing to be performed correctly, the continuous film must reach the forming tube in a specific position, such that the longitudinal edges of the film overlap one another as required when the film tube is generated. Machines comprising a detection device upstream of the forming tube in the forward movement direction of the film for detecting the longitudinal edge of said film and therefore being able to detect a possible off-centering thereof are known. These machines comprise at least one actuator for causing the transverse movement of the film (by moving at least one element feeding said film to the forming tube), when it has been detected that it is off-center.

EP2276668A1 discloses a vertical packaging machine comprising a frame, a feed module attached with freedom of movement to the frame and configured for supplying a continuous film initially wound in the form of a reel to a fold forming module of the machine which is configured for generating at least one fold in said film, a forming tube configured for receiving said film from the fold forming module and for imparting a tubular shape to said film. The machine further comprises a detection device arranged between the fold forming module and the forming tube configured for detecting the position of a longitudinal edge of the film, a control unit communicated with said detection device, and an actuator configured for moving the feed module with respect to the frame, in order to laterally adjust the position of the film.

JP2013103752A discloses a vertical packaging machine comprising a frame; a reel holder where a film is wound; a feed module which is attached to the frame, which is configured to supply the film from said reel holder and which comprises a guide mechanism to guide the supply of said film; a fold forming module configured to receive said film from the feed module, said fold forming module comprising fold forming blocks for generating at least one longitudinal fold in said film and a support mechanism for the blocks; a forming tube configured to receive from the fold-forming module the film comprising at least one fold; detection means configured to perform a first detection in a part of said film arranged between the forming tube and the fold forming module, to detect the position of a first reference of the film; and an actuator for causing displacement of the guide mechanism of the feed module with respect to the frame in response to said first detection. The detection means is further configured to perform at least one additional detection in a part of the film downstream of the fold forming module, to detect the position of folds already made, and the support mechanism of the fold forming module comprises an actuator for moving the blocks of said fold forming module, to adjust the position of the fold with respect to longitudinal edges of the film in response to the second detection.

SUMMARY

Disclosed is a vertical packaging machine and a control method.

A first aspect of the invention relates to a vertical packaging machine. The machine comprises a frame; a feed module attached to the frame, configured for supplying a film; and a fold forming module configured for receiving said film coming from the feed module and for generating at least one longitudinal fold in said film; a forming tube configured for receiving said film with at least one longitudinal fold coming from the fold forming module; and detection means configured for performing a first detection in a part of said film arranged between the forming tube and the fold forming module, for detecting the position of a first reference of the film.

The feed module is attached to the frame with freedom of movement and comprises a reel holder in which the film to be supplied is wound as a reel. The machine further comprises actuation means with a first actuator configured for causing the movement of at least the feed module with respect to the frame, in order to move the film laterally, and with a second actuator configured for moving the fold forming module at least with respect to the feed module, in order to adjust the position of the fold formed by said fold forming module with respect to the longitudinal edges of the film, and a control unit communicated with the actuation means and configured for being able to cause, while the film is being supplied, the first actuator to move at least the feed module with respect to the frame and the second actuator to move the fold forming module at least with respect to the feed module.

The proposed machine thereby allows the position of the fold forming module to be adjusted both in a coordinated manner with the feed module and independently, in addition to also allowing the position of the feed module to be adjusted, whereby the required arrangement of the folds in the film with respect to the longitudinal edges of said film can be assured at all times, while at the same time maintaining the possibility of adjusting the lateral position of the film.

In a packaging operation in a vertical packaging machine, once the film reaches a forming tube of the machine arranged downstream of the fold forming module, said forming tube imparts a tubular shape to said film and a longitudinal sealing tool of said machine seals said longitudinal edges to one another to longitudinally close the resulting vertical film tube. With the adjustment of the position of the longitudinal edges of the film and of the folds with respect to said longitudinal edges made possible by the proposed machine, the longitudinal edges can be arranged in the required position at the inlet of the forming tube, based on the position of the longitudinal sealing tool, for example, for being able to obtain a correct or required longitudinal sealing between said longitudinal edges, and a final package with a suitable longitudinal sealing can therefore be obtained.

Likewise, the adjustment of the position of the folds with respect to the longitudinal edges allows being able to obtain a final package with the required arrangement of said folds with respect to the longitudinal sealing, such that a package with the required appearance, for example, and/or with the fold in a position more suited for correctly supporting the product packaged in said package can be obtained. The state of the art, however, discloses the fixed relative position between the forming tube and the fold forming module, with the longitudinal sealing tool and said fold forming module being in the same relative position with respect to one another at all times, as being advantageous. However, if for any reason the film is moved laterally with respect to the forming tube (and, therefore, with respect to the fold forming module) and the position of said film is adjusted or modified, it has been discovered that said lateral movement of the film with respect to the fold forming module generates a variation in stresses generated by said fold forming module in the film, and as a result of said variation, the position of the fold generated in the film can be moved with respect to the longitudinal edges of said film, such that the positioning of the folds may not be the correct positioning in all circumstances, and this affects at least the appearance and the shape of the final package.

With the proposed solution, in addition to adjusting the position of the film with respect to the forming tube to position the longitudinal edges in a required position as a result of the possibility of moving the feed module with respect to the frame, as a result of the possibility of moving the fold forming module the folds are also always kept in the required position with respect to said longitudinal edges of the film, regardless of the required adjustments of the position of the film.

Furthermore, both the adjustment of the position of the film and the adjustment of the position of the folds with respect to the longitudinal edges of the film can be done automatically and continuously, without requiring the machine to be stopped to perform said adjustments and without needing an operator to check the position of the folds in the generated packaged every so often, such that a higher machine productivity is obtained. By making said adjustments before imparting a tubular shape to the film in the forming tube, the amount of packaging that may be defective is also reduced to a minimum (due to the problem of an incorrect arrangement of the folds or of the film).

The detection means is configured to carry out a second detection to detect the position of a second reference of the film in a part of said film arranged upstream of the fold-forming module, preferably between the feed module and said fold forming module, the control unit being also in communication with the detection means, and configured to cause, based on the first detection made by the detection means, that the actuation means causes a coordinated and/or joint displacement of the feed module and the fold forming module with respect to the frame in such a way that the film moves laterally without the fold changing its position with respect to the longitudinal edge of the film, and to cause, depending on the second detection made by the detection means, that the actuation means causes the displacement of the form forming module with respect to the feed module such that, after said displacement the fold generated by said fold forming module varies its position with respect to the longitudinal edge of the film in comparison with the fold generated before said displacement.

In this way, thanks to the second detection, it is possible to adjust the position of the fold forming module with respect to the film to make the folds in the required position, and therefore the position of the folds in the film, completely independent of the feed module, without affecting any other element of the machine and without affecting the width and/or shape of the fold. In addition, thanks to where the second detection is performed this can be done before the folds are made, so that the folds are formed in the required position on the film and waste due to mispositioning of the folds with relative to the film is avoided (or at least the risk or amount of waste is reduced).

In addition, thanks to the first detection, the position of the film can be adjusted so that it reaches the forming tube correctly, the feed module and the fold-forming module being further displaced in a coordinated and/or joint manner for that purpose. Furthermore, this displacement does not affect the folds themselves in any way, since there is no relative displacement between elements that directly or indirectly influence the generation of the folds.

In the proposed machine, it is thus possible to independently adjust the position of the folds with respect to the longitudinal edges of the film on the one hand, and the position of the film itself (including the folds) with respect to the forming tube on the other side.

A second aspect of the invention relates to a control method for a vertical packaging machine which comprises supplying a film to a forming tube of the machine from a reel holder of a feed module of said machine; generating at least one longitudinal fold in said supplied film on its path between the feed module and the forming tube, by means of a fold forming module of said machine; and imparting a tubular shape to said film with at least one longitudinal fold by means of the forming tube.

In the method, furthermore, while the film is being supplied, the feed module and the fold forming module are moved with respect to the frame, if so required, in order to laterally adjust the position of the film without the relative position between the fold and longitudinal edges of the film being affected, and the fold forming module is moved with respect to the feed module, if so required, in order to adjust the relative position between said fold and said longitudinal edges of the film.

In the method, furthermore, a first detection of a first reference of the film is performed, in a part of said film arranged between the forming tube and the fold forming module; a second detection of a second reference of the film is performed, in a part of said film arranged upstream the fold forming module, preferably between the feed module and said fold forming module; a coordinated and/or joint movement of the feed module and of the fold forming module with respect to the frame is caused based on the first detection, in order to laterally adjust the position of the film without the relative position between the fold and longitudinal edges of the film being affected; and a movement of the fold forming module with respect to the feed module is caused based on the second detection, in order to adjust the relative position between said fold and said longitudinal edges of the film.

The advantages described for the machine are also obtained with the method.

These and other advantages and features will become apparent in view of the figures and detailed description.

DETAILED DESCRIPTION

Figure 1:
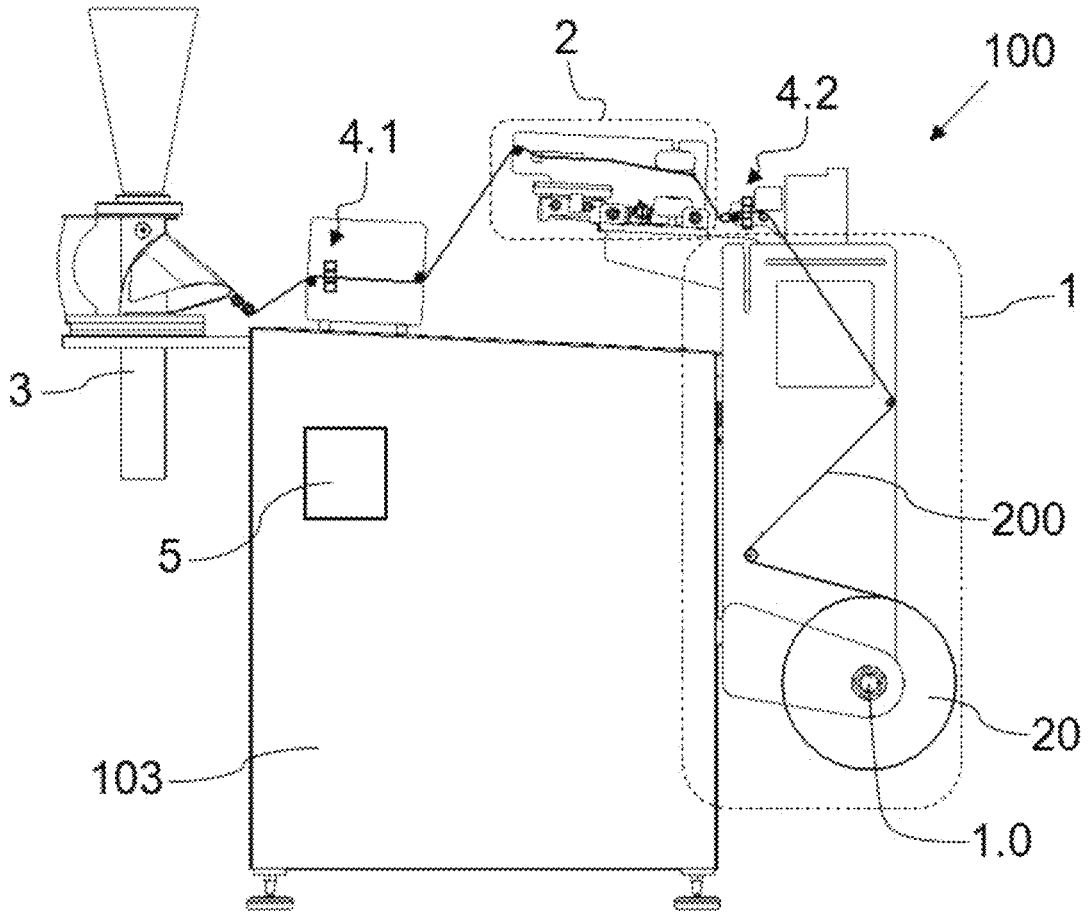
FIG. 1 shows a schematic side view of a first embodiment of a vertical packaging machine.
Figure 2:
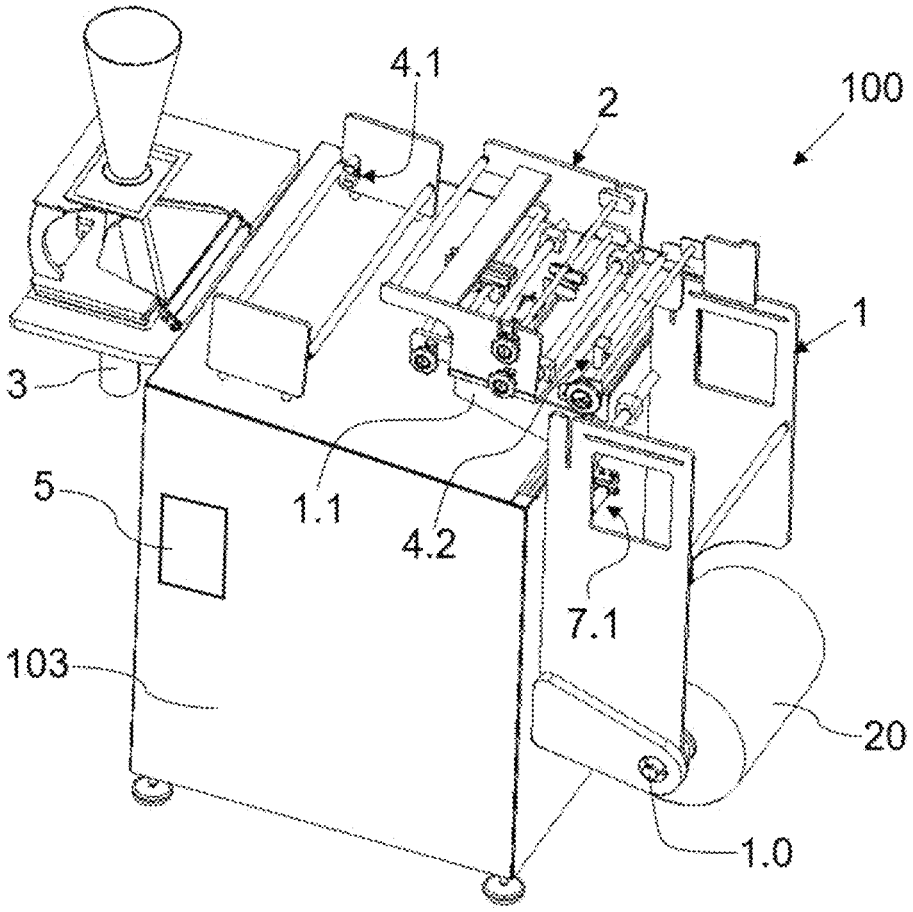
FIG. 2 shows a perspective view of the machine of FIG. 1.
Figure 3:
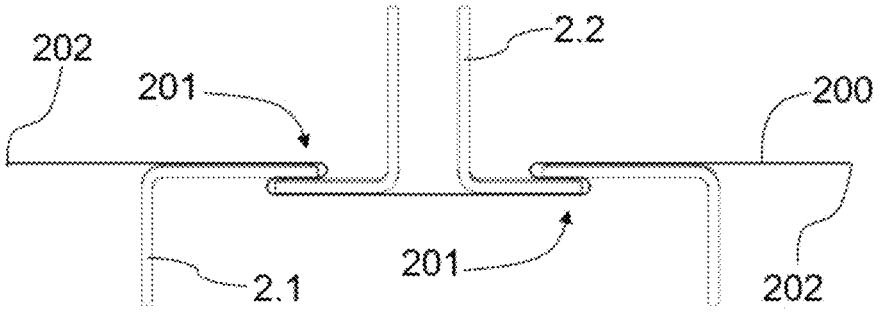
FIG. 3 shows by way of example a cross-section view of a film with two folds.

FIGS. 1 and 2 show a first embodiment of a vertical packaging machine 100. The machine 100 comprises a frame 103; a feed module 1 attached with freedom of movement to the frame 103 and configured for supplying a film 200, which is usually wound in the form of a reel 20 in a reel holder 1.0 of the feed module 1; and a fold forming module 2 configured for receiving said film 200 coming from the feed module 1 and for generating at least one longitudinal fold 201 in said film 200, as shown by way of example in FIG. 3. The fold forming module 2 is configured for being moved with respect to the frame 103 and with respect to the feed module 1.

The machine 100 comprises actuation means with a first actuator 7.1, which preferably comprises a hydraulic or pneumatic cylinder, configured for causing the movement of at least the feed module 1 with respect to the frame 103, and with a second actuator 7.2, which preferably comprises a hydraulic or pneumatic cylinder, configured for moving the fold forming module 2 at least with respect to the feed module 1, in order to adjust the position of the fold 201 with respect to longitudinal edges 202 of the film 200.

The machine 100 comprises a control unit 5 communicated with the actuation means and configured for being able to cause, while the film 200 is being supplied, the first actuator 7.1 to move at least the feed module 1 with respect to the frame 103 and the second actuator 7.2 to move the fold forming module 2 at least with respect to the feed module 1.

The machine 100 may comprise different configurations. For example, in a first configuration, the feed module 1 is attached with freedom of movement to the frame 103 and the fold forming module 2 is also attached with freedom of movement to the frame 103, as occurs in the second embodiment of the machine 100 depicted by way of example in FIG. 4, with the fold forming module 2 not being attached to the feed module 1. The fold forming module 2 and the feed module 1 are preferably attached to the frame 103 such that they move in parallel in response to the first detection. In the first configuration, the second actuator 7.2 is configured for moving the fold forming module 2 with respect to the frame 103 and also with respect to the feed module 1, if so required, and, therefore, the first actuator 7.1 is not configured for moving the fold forming module 2.

In a second configuration, the feed module 1 is attached with freedom of movement to the frame 103 and the fold forming module 2 is attached with freedom of movement to the feed module 1 (and not to the frame 103), as occurs in the first embodiment of the machine 100 depicted by way of example in FIGS. 1 and 2. In these embodiments, the first actuator 7.1 is configured for causing a joint movement of said feed module 1 and of said fold forming module 2 with respect to the frame 103, since both modules 1 and 2 are attached.

The feed module 1 preferably comprises a segment 1.1 to which the fold forming module 2 is attached. In the second configuration, the second actuator 7.2 is configured to move the fold forming module 2 with respect to the feed module 1.

Therefore, the machine 100 may comprise a configuration selected from at least the first configuration and the second configuration.

The first actuator 7.1 preferably comprises a fixed element (a cylinder base or housing, in the case of a cylinder) associated with the frame 103 and a mobile element (cylinder piston, in the case of a cylinder) attached to the feed module 1 and movable with respect to the fixed element, and the second actuator 7.2 comprises a fixed element associated with the frame 103 or with the feed module 1 based on the embodiment of the machine 100 such that it remains fixed with respect to the frame 103 or with respect to the feed module 1, whichever is appropriate, and a mobile element attached to the fold forming module 2 and movable with respect to the fixed element. For example, the fold forming module 2 may comprise a plate 2.0 which is attached to the frame 103 or to the feed module 1 (for example to segment 1.1) based on the embodiment of the machine 100, and the fixed element of the second actuator 7.2 is attached to said plate 2.0.

The machine 100 comprises a forming tube 3 configured for receiving said film 200 with at least one longitudinal fold 201 coming from the fold forming module 2 and for imparting a tubular shape to said film 200; a longitudinal sealing tool (not depicted in the figures) configured for sealing the longitudinal edges 202 of the film 200 with a tubular shape to one another, a film tube (not depicted in the figures) being formed; and a transverse sealing and cutting tool (not depicted in the figures) below the forming tube 3 for transversely sealing and cutting the film tube, an individual package being obtained downstream of the cut and a closed film tube being obtained upstream of said cut.

The machine 100 may also comprise detection means configured for performing a first detection with which it detects the position of a first reference of the film 200, in a part of said film 200 arranged between the forming tube 3 and the fold forming module 2; actuation means configured for moving the feed module 1 with respect to the frame 103 such that the film 200 is moved laterally; and a control unit 5 communicated with the detection means and with the actuation means (with the two actuators 7.1 and 7.2). This allows the film 200 to be laterally moved if the detection means detects that a first reference of said film 200 is not correctly positioned before being supplied to the forming tube 3, the position of said film 200 being possible to be adjusted before being incorrectly positioned with respect to the forming tube 3, for the subsequent longitudinal sealing between the longitudinal edges 202 of the film 200 to be performed in the corresponding location.

The control unit 5 is configured for being communicated in real time both with the detection means and with the actuation means, such that the position can be adjusted automatically and in real time, without needing to stop the machine 100, with the advantages this entails (increased productivity because shutdowns are prevented, the process is automated, and packaging waste is reduced, for example).

The first reference can be one of the two longitudinal edges 202 of the film 200, a hole or a cut comprised in the film 200, or an impression comprised in said film 200. The first reference is preferably one of the two longitudinal edges 202 of the film 200.

The detection means is furthermore configured for performing a second detection with which it detects the position of a second reference of the film 200, and the actuation means is furthermore configured for moving the fold forming module 2. The control unit 5 is configured for causing, based on the first detection performed by the detection means, the actuation means to cause a coordinated movement of the feed module 1 and of the fold forming module 2 with respect to the frame 103 such that the film 200 is moved laterally without the position of the fold 201 resulting from the fold forming module 2 changing with respect to the longitudinal edge 202 of the film 200. Therefore, in the embodiments in which both the feed module 1 and the fold forming module 2 are attached with freedom of movement to the frame 103, like in the second embodiment depicted in FIG. 4, based on the first detection, the control unit is configured for causing a coordinated actuation between the first actuator 7.1 and the second actuator 7.2, such that the film 200 is moved laterally as a result of the movement of the feed module 1 and the relative position between said film 200 and the fold forming module 2 does not change; and in the embodiments in which the fold forming module 2 is attached with freedom of movement to the feed module 1, like in the first embodiment depicted in FIGS. 1 and 2, the control unit 5 is configured for causing an actuation of the first actuator 7.1 and said actuation causes an integral movement of said feed module 1 and said fold forming module 2.

The control unit 5 is furthermore configured for causing, based on the second detection performed by the actuation means, the actuation means to cause the movement of the fold forming module 2 with respect to the feed module 1 such that the position of the resulting fold 201 subsequent to the movement changes with respect to the longitudinal edges 202 of the film 200, compared with the fold 201 made before said movement. This second actuation involves a movement of the fold 201 resulting from the fold forming module 2 with respect to the longitudinal edges 202 of said film 200, compared with the fold 201 resulting from the fold forming module 2 before said second actuation. Therefore, based on the second detection, the control unit 5 is configured for causing an actuation of the second actuator 7.2 in order to cause a movement of the fold forming module 2; and in the embodiments in which the fold forming module 2 with respect to the feed module 1.

As described below, in some examples the second detection can be performed on the part of the film 200 which is between the forming tube 3 and the fold forming module 2, in which case the second reference is a fold 201 of said film 200 or an impression in the film 200 arranged in said fold 201. Preferably, in these cases said second reference is a fold 201 of said film 200. In the event that the second reference is a fold 201, said fold 201 can be detected directly (by touching or by focusing the detection means on the fold 201) or deduced from the detection of the folded layers of the film 200 forming said fold 201 (detecting where there is more than one layer of the film 200), for example.

In any of the embodiments, the second detection is performed on a part of the film 200 which is upstream of the fold forming module 2, preferably between the feed module 1 and said fold forming module 2, as occurs for example in the first embodiment of the machine 100, in which case said second reference can be one of the two longitudinal edges 202 of the film 200, a hole or cut comprised in the film 200, or an impression comprised in said film 200. Preferably, in these cases said second reference is one of the two longitudinal edges 202.

Preferably, the detection means comprise a first detector 4.1 for detecting the first reference and a second detector 4.2 for detecting the second reference, with the control unit 5 being communicated with both detectors 4.1 and 4.2. Preferably, the first detector 4.1 comprises a photocell and the second detector 4.2 comprises a photocell, although detectors of another type may also be possible (and the two detectors 4.1 and 4.2 would not have to be the same).

Figure 4:
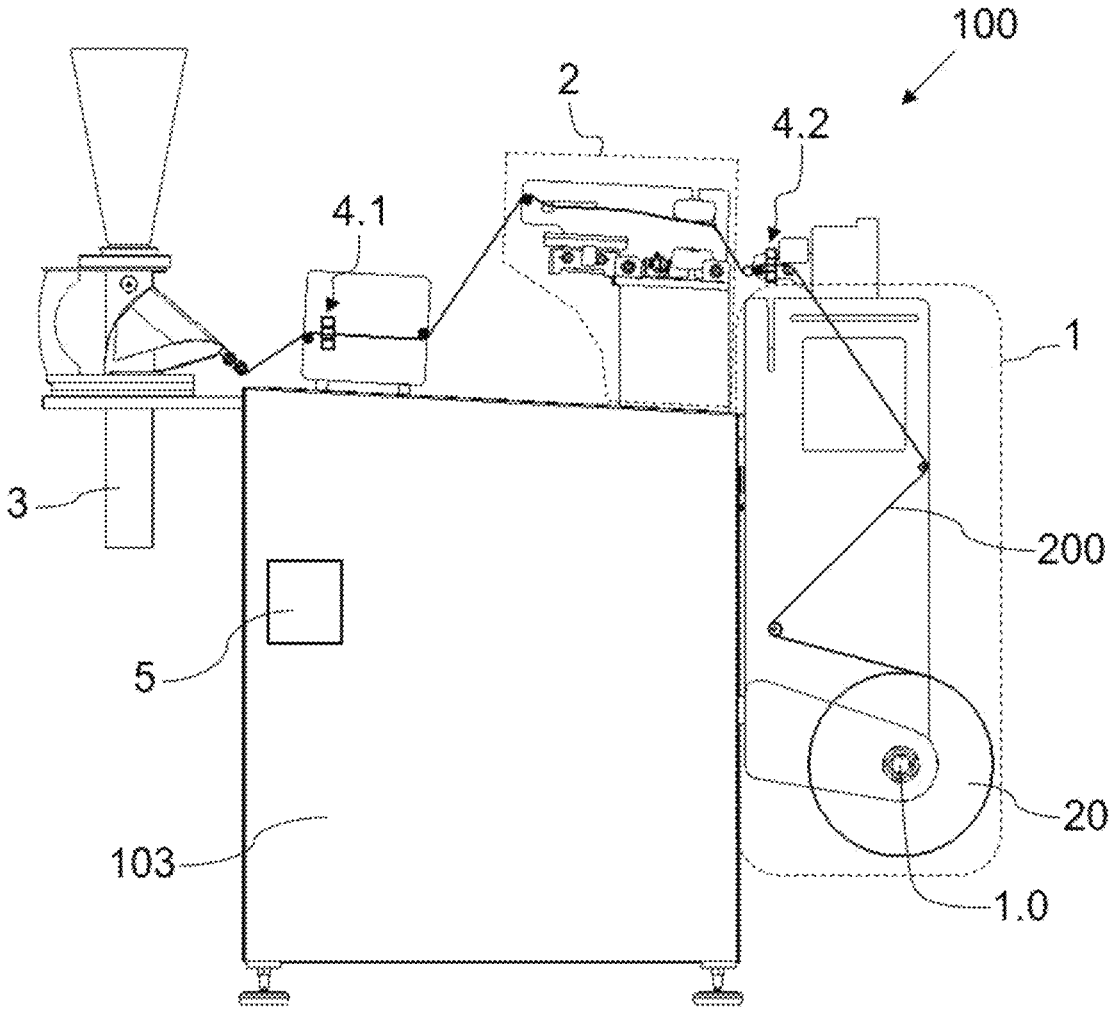
FIG. 4 shows a schematic side view of a second embodiment of a vertical packaging machine.

In the embodiments of the machine 100 in which the detection means comprises two detectors 4.1 and 4.2, as shown in FIGS. 1 and 4, the first detector 4.1 is arranged between the forming tube 3 and the fold forming module 2 and the second detector 4.2 is arranged upstream of the fold forming module 2 and configured for detecting the second reference of the part of the film 200 which is between said fold forming module 2 and the feed module 1.

Figure 5:
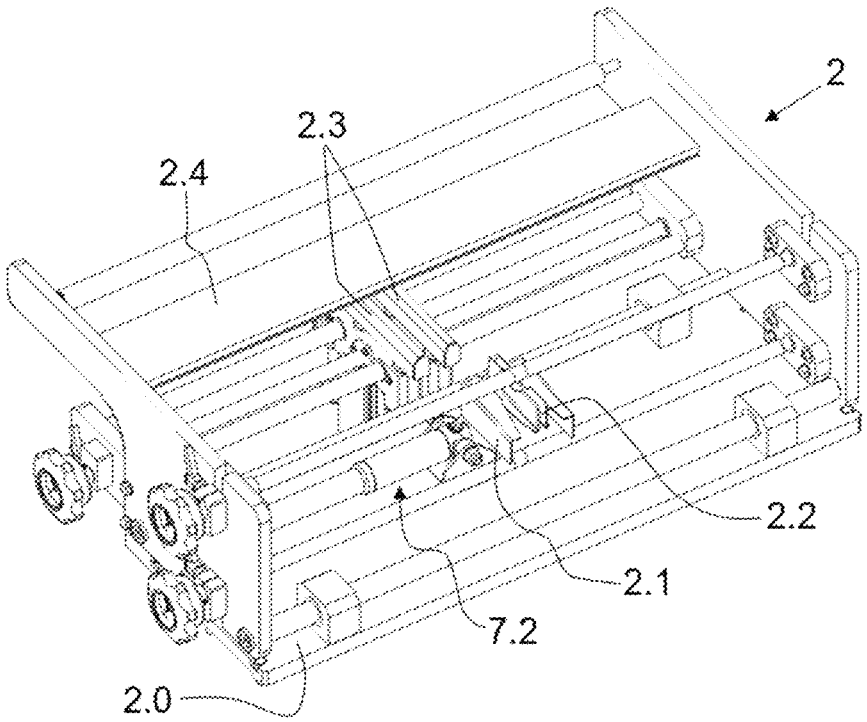
FIG. 5 shows a perspective view of a fold forming module of the first embodiment of the vertical packaging machine.
Figure 6:
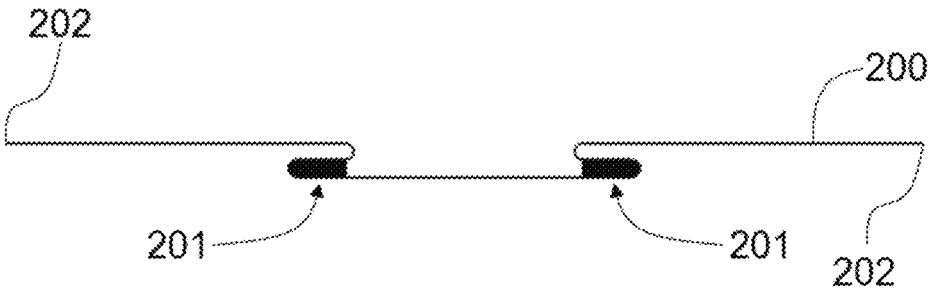
FIG. 6 shows some of the elements of the fold forming module of FIG. 5, making a fold in the film.

Preferably, as depicted in FIGS. 5 and 6, the fold forming module 2 comprises at least one film deformation support 2.1 for deforming the film 200; at least one folding tool 2.2 configured for making a fold in the film 200 deformed by the film deformer 2.1, with one section of the film 200 overlapping another section of said film 200; at least one sealing tool 2.3 for sealing both sections of the film 200 overlapping one another; and at least one support surface 2.4 on which the sealing tool 2.3 acts to perform sealing. The actuation means are configured for jointly moving at least the film deformation support 2.1, the folding tool 2.2, the sealing tool 2.3, and the support surface 2.4 of the fold forming module 2, when said actuation means move the fold forming module 2.

A second aspect of the invention relates to a control method for a vertical packaging machine. The method is configured for being able to be implemented in the machine 100 of the first aspect of the invention, said method comprising the suitable embodiment and/or configuration for the corresponding embodiment and/or configuration of said machine 100. In that sense, what has been stated for the machine 100 is also valid for the corresponding embodiment and/or configuration of the method, and vice versa.

The method comprises supplying a film 200 to a forming tube 3 of the machine 100 from a reel holder 1.0 of a feed module 1 of said machine 100; generating at least one longitudinal fold 201 in said supplied film 200 on its path between the feed module 1 and the forming tube 3, by means of a fold forming module 2 of said machine 100; and imparting a tubular shape to said film 200 with at least one longitudinal fold 201 by means of the forming tube 3.

In the method, furthermore, while the film is being supplied, the feed module and the fold forming module are moved with respect to the frame, if so required, in order to laterally adjust the position of the film without the relative position between the fold and longitudinal edges of the film being affected, and the fold forming module is moved with respect to the feed module, if so required, in order to adjust the relative position between said fold and said longitudinal edges of the film.

In the method, furthermore, a first detection of a first reference of the film 200 is performed, in a part of said film 200 arranged between the forming tube 3 and the fold forming module 2; a second detection of a second reference of the film 200 is performed; a movement of the feed module 1 and of the fold forming module 2 with respect to the frame 103 is caused based on the first detection, in order to laterally adjust the position of the film 200 without the relative position between the fold 201 and longitudinal edges 202 of the film 200 being affected; and a movement of the fold forming module 2 with respect to the feed module 1 is caused based on the second detection, in order to adjust the relative position between said fold 201 and said longitudinal edges 202 of the film 200.

In some embodiments of the method, the actuation of a first actuator 7.1 of the actuation means is caused in order to move the feed module 1 and the fold forming module 2 based on the first detection, and the actuation of a second actuator 7.2 of the actuation means is caused in order to move the fold forming module 2 with respect to the feed module 1 based on the second detection.

In other embodiments of the method, as has also been described for the machine 100, in order to move the feed module 1 and the fold forming module 2 based on the first detection, the actuation of a first actuator 7.1 of the actuation means is caused in order to move the feed module 1, and the actuation of a second actuator 7.2 of the actuation means is caused in order to move the fold forming module 2, with both actuations being coordinated for the film 200 to be moved laterally, but for the relative position between the longitudinal edges 202 of the film and the fold 201 not to be varied, and the actuation of the second actuator 7.2 of the actuation means is caused in order to move the fold forming module 2 with respect to the feed module 1 based on the second detection.

In the method, as has also been described for the machine 100, the second detection is performed on a part of the film 200 arranged between said fold forming module 2 and the feed module 1 (by detecting, for example, a reference of the film 200 selected from a longitudinal edge 202 of said film 200, a hole or cut in said film 200, and an impression in said film 200).

Embodiments are also disclosed in the clauses that follow.

Clause 1. Vertical packaging machine comprising a frame (103); a feed module (1) attached to the frame (103) and configured for supplying a film (200); a fold forming module (2) configured for receiving said film (200) coming from the feed module (1) and for generating at least one longitudinal fold (201) in said film (200); a forming tube (3) configured for receiving the film (200) with at least one fold (201) coming from the fold forming module (2); and detection means configured for performing a first detection in a part of said film (200) arranged between the forming tube (3) and the fold forming module (2), for detecting the position of a first reference of the film (200), the feed module (1) is attached to the frame (103) with freedom of movement and comprises a reel holder (1.0) in which the film to be supplied is wound as a reel (20), the machine (100) further comprising actuation means with a first actuator (7.1) configured for causing the movement of at least the feed module (1) with respect to the frame (103), in order to move the film (200) laterally, and with a second actuator (7.2) configured for moving the fold forming module (2) at least with respect to the feed module (1), in order to adjust the position of the fold (201) formed by said fold forming module (2) with respect to longitudinal edges (202) of the film (200); and a control unit (5) communicated with the actuation means and configured for being able to cause, while the film (200) is being supplied, the first actuator (7.1) to move at least the feed module (1) with respect to the frame (103) and the second actuator (7.2) to move the fold forming module (2) at least with respect to the feed module (1), the detection means being also configured for performing a second detection for detecting the position of a second reference of the film (200) in a part of said film (200) arranged upstream the fold forming module (2), preferably between the feed module (1) and said fold forming module (2), the control unit (5) being also communicated with the detection means and configured for causing, based on the first detection performed by the detection means, the actuation means to cause a coordinated and/or joint movement of the feed module (1) and of the fold forming module (2) with respect to the frame (103) such that the film (200) is moved laterally without the position of the fold (201) changing with respect to the longitudinal edge of the film (200), and for causing, based on the second detection performed by the detection means, the actuation means to cause the movement of the fold forming module (2) with respect to the feed module (1) such that after said movement, the position of the fold (201) generated by said fold forming module (2) changes with respect to the longitudinal edge (202) of the film (200) compared with the fold (201) generated before said movement.

Clause 2. Vertical packaging machine according to clause 1, wherein the feed module (1) is attached with freedom of movement to the frame (103) and the fold forming module (2) is attached with freedom of movement to the frame (103), with the second actuator (7.2) being configured for moving said fold forming module (2) also with respect to the frame (103).

Clause 3. Vertical packaging machine according to clause 1, wherein the feed module (1) is attached with freedom of movement to the frame (103) and the fold forming module (2) is attached with freedom of movement to the feed module (1), with the first actuator (7.1) being configured for causing a joint movement of said feed module (1) and of said fold forming module (2) with respect to the frame (103).

Clause 4. Vertical packaging machine according to any of clauses 1 to 3, wherein the detection means comprises a first detection device (4.1) configured for detecting the position of the first reference and arranged between the forming tube (3) and the fold forming module (2), and a second detection device (4.2) configured for detecting the position of the second reference and arranged between the feed module (1) and the fold forming module (2).

Clause 5. Vertical packaging machine according to clause 4, wherein the first detection device (4.1) is configured for detecting the first reference selected from a longitudinal edge (202) of said film (200), a hole or cut in said film (200) and an impression in said film (200), preferably a longitudinal edge (202) of the film (200), and the second detection device (4.2) is configured for detecting the second reference selected from a longitudinal edge (202) of said film (200), a hole or cut in said film (200) and an impression in said film (200), preferably a longitudinal edge (202) of the film (200).

Clause 6. Vertical packaging machine according to any of clauses 1 to 5, wherein the detection means comprises a first photocell for detecting the first reference of the film (200) and a second photocell for detecting the second reference of said film (200).

Clause 7. Vertical packaging machine according to any of clauses 1 to 6, wherein the first actuator (7.1) comprises a fixed element associated with the frame (103) and a mobile element attached to the feed module (1) and movable with respect to the fixed element, and wherein the second actuator (7.2) comprises a fixed element associated with the frame (103) or associated with the feed module (1) and a mobile element attached to the fold forming module (2) and movable with respect to the fixed element.

Clause 8. Vertical packaging machine according to any of clauses 1 to 7, wherein the fold forming module (2) comprises at least one film deformation support (2.1) for deforming the film (200); at least one folding tool (2.2) configured for making a fold in the film (200) deformed by the film deformation support (2.1), with one section of the film (200) overlapping another section of said film (200); at least one sealing tool (2.3) for sealing both sections of the film (200) overlapping one another; and at least one support surface (2.4) on which the sealing tool (2.3) acts for performing sealing, with the actuation means being configured for jointly moving at least the film deformation support (2.1), the folding tool (2.2), the sealing tool (2.3), and the support surface (2.4) when they move the fold forming module (2) with respect to the feed module (1).

Clause 9. Control method for a vertical packaging machine comprising the operations of supplying a film (200) to a forming tube (3) of the machine (100) from a reel holder (1.0) of a feed module (1) of said machine (100); generating at least one longitudinal fold (201) in said supplied film (200) on its path between the feed module (1) and the forming tube (3), by means of a fold forming module (2) of said machine (100); and imparting a tubular shape to said film (200) with at least one longitudinal fold (201) by means of the forming tube (3), the method, furthermore, while the film (200) is being supplied, the feed module (1) and the fold forming module (2) are moved with respect to the frame (103), if so required, in order to laterally adjust the position of the film (200) without the relative position between the fold (201) and longitudinal edges (202) of the film (200) being affected, and the fold forming module (2) is moved with respect to the feed module (1), if so required, in order to adjust the relative position between said fold (201) and said longitudinal edges (202) of the film (200); a first detection of a first reference of the film (200) is performed, in a part of said film (200) arranged between the forming tube (3) and the fold forming module (2); a second detection of a second reference of the film (200) is performed, in a part of said film (200) arranged upstream the fold forming module (2), preferably between the feed module (1) and said fold forming module (2); a coordinated and/or joint movement of the feed module (1) and of the fold forming module (2) with respect to the frame (103) is caused based on the first detection, in order to laterally adjust the position of the film (200) without the relative position between the fold (201) and longitudinal edges (202) of the film (200) being affected; and a movement of the fold forming module (2) with respect to the feed module (1) is caused based on the second detection, in order to adjust the relative position between said fold (201) and said longitudinal edges (202) of the film (200).

10. Control method according to clause 9, wherein the actuation of a first actuator (7.1) of the actuation means is caused in order to move the feed module (1) and the fold forming module (2) based on the first detection, and the actuation of a second actuator (7.2) of the actuation means is caused in order to move the fold forming module (2) with respect to the feed module (1) based on the second detection.

Clause 11. Control method according to clause 10, wherein the actuation of a first actuator (7.1) of the actuation means is caused in order to move the feed module (1) based on the first detection, the actuation of a second actuator (7.2) is caused in order to move the fold forming module (2) based on the first detection, with the movements of the feed module (1) and of the fold forming module (2) based on the first detection being coordinated for the film (200) to be moved laterally but for the relative position between the longitudinal edges (202) of the film and the fold (201) not to be varied, and the actuation of the second actuator (7.2) of the actuation means is caused in order to move the fold forming module (2) with respect to the feed module (1) based on the second detection.

Clause 12. Control method according to any of clauses 9 to 11, wherein a longitudinal edge (202) of said film (200), a hole or cut in said film (200), or an impression in said film (200), preferably a longitudinal edge (202) of the film (200), is identified as the first reference, and a longitudinal edge (202) of said film (200), a hole or cut in said film (200) or an impression in said film (200), preferably.

What is claimed is:

1. A vertical packaging machine comprising:

a frame;

a feed module attached to the frame with freedom of movement and configured to supply a film, the feed module including a reel holder on which the film to be supplied is wound as a reel;

a fold forming module configured to receive the film supplied from the feed module and to generate a longitudinal fold in the film;

a forming tube configured to receive the film with the longitudinal fold coming from the fold forming module;

detection means configured to perform a first detection in a part of the film located between the forming tube and the fold forming module for detecting a position of a first reference of the film;

actuation means with first and second actuators, the first actuator configured to move the feed module with respect to the frame in order to move the film laterally, the second actuator configured to move the fold forming module with respect to the feed module to adjust a position of the fold formed by the fold forming module with respect to a longitudinal edge of the film; and a control unit configured to cause the first actuator to move the feed module with respect to the frame and the second actuator to move the fold forming module with respect to the feed module while the film is being supplied, the detection means being configured to perform a second detection for detecting a position of a second reference of the film in a part of the film located upstream the fold forming module, the control unit being communicated with the detection means and configured to cause, based on the first detection performed by the detection means, the actuation means to cause a coordinated and/or joint movement of the feed module and of the fold forming module with respect to the frame such that the film is moved laterally without a position of the fold changing with respect to the longitudinal edge of the film, and for causing, based on the second detection performed by the detection means, the actuation means to cause the movement of the fold forming module with respect to the feed module such that after said movement, the position of the longitudinal fold generated by the fold forming module changes with respect to the longitudinal edge of the film compared with the longitudinal fold generated before said movement.

2. The vertical packaging machine according to claim 1, wherein the detection means is configured to perform the second detection for detecting the position of the second reference of the film in the part of the film located between the feed module and the fold forming module.

3. The vertical packaging machine according to claim 1, wherein the fold forming module is attached with freedom of movement to the frame, with the second actuator being configured to move the fold forming module with respect to the frame.

4. The vertical packaging machine according to claim 1, wherein the fold forming module is attached with freedom of movement to the feed module and the first actuator is configured to cause a joint movement of the feed module and of the fold forming module with respect to the frame.

5. The vertical packaging machine according to claim 1, wherein the detection means comprises a first detection device configured to detect the position of the first reference, and a second detection device configured to detect the position of the second reference, the second detecting device being located between the feed module and the fold forming module.

6. The vertical packaging machine according to claim 5, wherein the first reference is selected from the group consisting of the longitudinal edge of the film, a hole in the film, a cut in the film and an impression in the film.

7. The vertical packaging machine according to claim 5, wherein the first reference is the longitudinal edge of the film.

8. The vertical packaging machine according to claim 5, wherein the second reference is selected from the group consisting of the longitudinal edge of the film, a hole in the film, a cut in the film and an impression in the film.

9. The vertical packaging machine according to claim 5, wherein the second reference is the longitudinal edge of the film.

10. The vertical packaging machine according to claim 1, wherein the detection means comprises a first photocell for detecting the first reference of the film and a second photocell for detecting the second reference of the film.

11. The vertical packaging machine according to claim 1, wherein the first actuator comprises a first fixed element associated with the frame and a first mobile element attached to the feed module and movable with respect to the first fixed element, and wherein the second actuator comprises a second fixed element associated with the frame and a second mobile element attached to the fold forming module and movable with respect to the second fixed element.

12. The vertical packaging machine according to claim 1, wherein the first actuator comprises a first fixed element associated with the frame and a first mobile element attached to the feed module and movable with respect to the first fixed element, and wherein the second actuator comprises a second fixed element associated with the feed module and a second mobile element attached to the fold forming module and movable with respect to the second fixed element.

13. The vertical packaging machine according to claim 1, wherein the fold forming module comprises:

a film deformation support for deforming the film;

a folding tool configured to make the longitudinal fold in the film deformed by the film deformation support so that a first section of the film overlaps a second section of the film;

a sealing tool configured to seal together the overlapping first and second sections; and a support surface on which the sealing tool acts to seal together the overlapping first and second sections, the actuation means being configured to jointly move the film deformation support, the folding tool, the sealing tool, and the support surface when the fold forming module is moved with respect to the feed module.

* * * * *